US009099812B2

(12) United States Patent
Sugimoto

(10) Patent No.: US 9,099,812 B2
(45) Date of Patent: Aug. 4, 2015

(54) CONNECTOR

(71) Applicant: Sumitomo Wiring Systems, Ltd., Yokkaichi, Mie (JP)

(72) Inventor: Shinpei Sugimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 64 days.

(21) Appl. No.: 14/024,782

(22) Filed: Sep. 12, 2013

(65) Prior Publication Data

US 2014/0087580 A1 Mar. 27, 2014

(30) Foreign Application Priority Data

Sep. 25, 2012 (JP) ..... 2012-210405

(51) Int. Cl.
*H01R 13/627* (2006.01)
*H01R 13/64* (2006.01)

(52) U.S. Cl.
CPC ..... *H01R 13/64* (2013.01); *H01R 13/6272* (2013.01)

(58) Field of Classification Search
CPC ..... H01R 13/6257; H01R 13/6275
USPC ..... 439/358, 357, 353
See application file for complete search history.

(56) References Cited

U.S. PATENT DOCUMENTS

| | | | | |
|---|---|---|---|---|
| 6,616,481 | B2 | 9/2003 | Ichio | |
| 8,337,235 | B2 * | 12/2012 | Mizutani et al. | 439/358 |
| 2012/0219357 | A1 * | 8/2012 | Mizutani et al. | 403/321 |

* cited by examiner

*Primary Examiner* — Phuong Dinh
(74) *Attorney, Agent, or Firm* — Gerald E. Hespos; Michael J. Porco; Matthew T. Hespos

(57) ABSTRACT

Protection walls (31) stand on an upper surface of a connector housing (11) and a lock arm (17) is arranged between them. A planar portion (44) is formed on the upper surface of the lock arm (17) and is connected to the protection walls (31). Grooves (45) extend forward from the rear of the planar portion (44) and a part of the planar portion (44) before the groove (45) defines a deflection support (16) of the lock arm (17). Reverse-turn preventing walls (47) protrude in from the protection walls (31) and reverse-turn preventing pieces (50) protrude out from the lock arm (17) below the reverse-turn preventing walls (47). The reverse-turn preventing pieces (50) contact the reverse-turn preventing walls (47) to limit deflection of the lock arm (17). The deflection support (46) and the reverse-turn preventing walls (47) are at the same height to miniaturize the connector height.

9 Claims, 7 Drawing Sheets

CONNECTOR

BACKGROUND

1. Field of the Invention

The invention relates to a connector.

2. Description of the Related Art

U.S. Pat. No. 6,616,481 discloses a connector with two facing surfaces at opposite sides of a lock arm that is used to lock the connector to a mating connector housing. A longitudinally central part of the lock arm is coupled to the facing surfaces so that the lock arm can be deflected and displaced like a seesaw with the coupled part as a deflection support.

An operating portion is defined at a rear end of the lock arm and reverse-turn restricting portions protrude out in a width direction from opposite lateral parts of the rear end of the lock arm. On the other hand, two receiving portions protrude in from the facing surfaces in correspondence with the reverse-turn restricting portions. By this configuration, the reverse-turn restricting portions contact the receiving portions to limit upward movement of the rear end of the lock arm.

The supports and the reverse-turn restricting portions are arranged at different heights in the above configuration. As a result, areas around the lock arm are extended in the height direction, resulting in a problem of enlarging the connector housing.

The invention was completed in view of the above situation and an object thereof is to provide a connector capable of miniaturizing a connector housing

SUMMARY OF THE INVENTION

The invention relates to a connector with a housing and two protection walls projecting from the housing. A resiliently deflectable lock arm is formed between the protection walls and is engageable with a mating connector to hold the connector and the mating connector in a connected state. The lock arm is connected to the protection walls and the connections define deflection support points for resilient deflection of the lock arm. A reverse-turn preventing wall protrudes from the protection wall toward the lock arm and lies in substantially the same plane as the deflection support points. A reverse-turn preventing piece protrudes out from the lock arm below the reverse-turn preventing wall and is configured to contact the reverse-turn preventing wall to limit reverse deflection of the lock arm that would move the rear end of the lock arm up.

The invention achieves miniaturization of the entire connector due to a reduction in the height of the connector housing since the deflection supports of the lock arm and the reverse-turn preventing wall are on the same height plane.

The connector preferably is configured so that a rear half of the lock arm behind the deflection support in a connecting direction includes a planar portion connected to both protection walls and forming a common plane. The planar portion has two grooves extending along the connecting direction from a rear edge to the deflection support. Thus, an operating portion for releasing a locking state of the lock arm is formed inwardly of the grooves in a width direction and two of the reverse-turn preventing walls are formed outwardly of the both grooves in the width direction.

The deflection support and the reverse-turn preventing walls are formed at the same height by forming the grooves in the planar portion on the rear half of the lock arm in the connecting direction. This configuration can be achieved by a mold that is opened along the connecting direction, thereby providing a simplified mold structure.

Seal towers preferably project back from the rear end of the connector housing and are arranged in rows along a height direction of the connector housing. The seal towers allow insertion of terminal fittings into the connector housing and can accommodate seals for achieving waterproofing. The protection wall extends back along the connecting direction and is connected to the outer peripheral surface of the seal tower arranged in the row closest to the lock arm. The seal towers have different backward extension lengths along the connector housing according to the types of the terminal fittings and are arranged so that the extension length becomes shorter from the seal towers closest to the lock arm to the seal towers most distant from the lock arm.

According to such a configuration, the long seal tower is in the row close to the lock arm and the short seal tower is in the row distant from the lock arm. If a reverse arrangement is adopted, the seal tower having a short extension length is between the protection wall (lock arm) having a relatively long extension length and the seal tower having a similarly long extension length. As a result, fingers are more likely to touch the protection wall (lock arm) and the long seal tower having when inserting the terminal fitting into the short seal tower. Therefore, an inserting operation may become difficult. In contrast, the inserting operation can be performed smoothly for the seal tower having the relatively short extension length, thereby increasing operational efficiency.

DETAILED DESCRIPTION OF THE PREFERRED EMBODIMENTS

Figure 2:
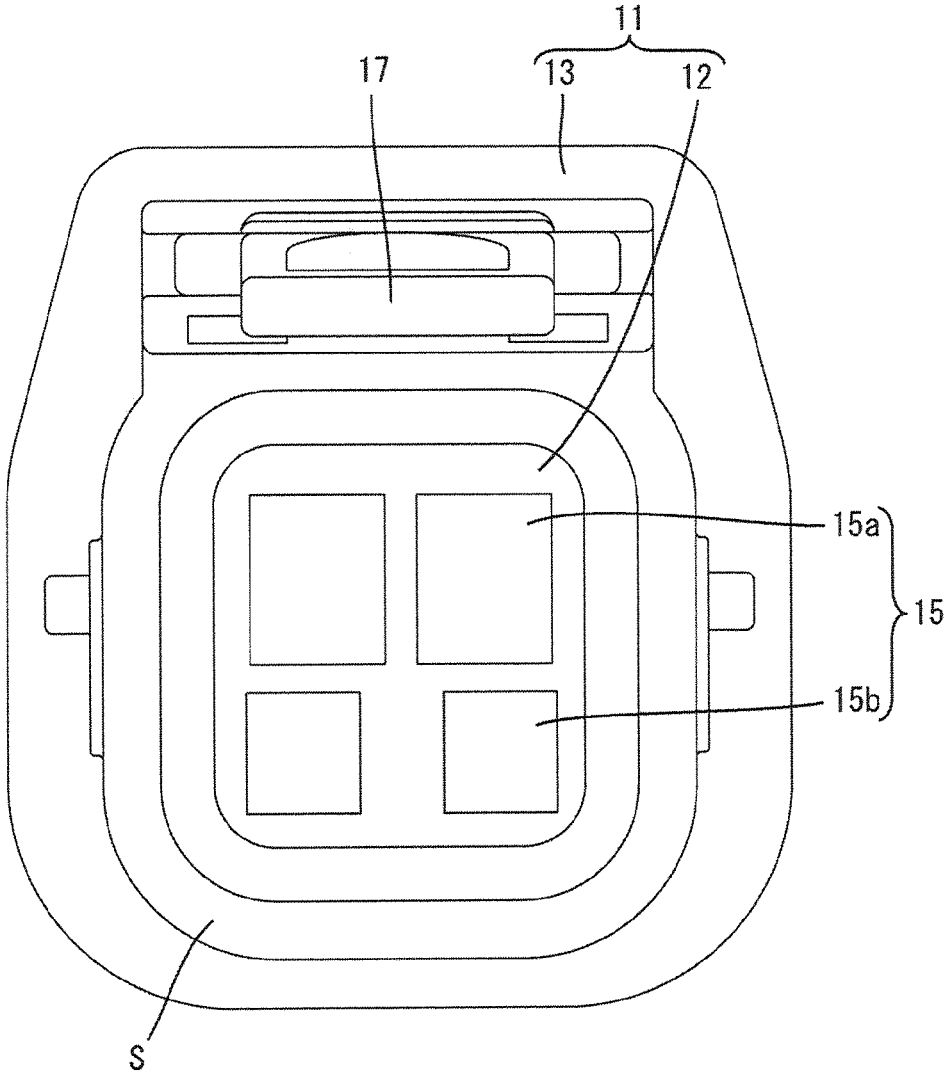
FIG. 2 is a front view of the female connector housing.

A connector according to an embodiment of the invention includes a female connector housing 11 made of synthetic resin. As shown in FIG. 2, the female connector housing 11 includes a main body 12 and a receptacle 13 arranged to surround the main body 12 from outside. A connection space S is defined between the receptacle 13 and the main body 12 for receiving a mating connector housing (not shown).

Large and small cavities 15*a* and 15*b* are formed respectively in upper and lower rows in the main body 12 for accommodating female terminal fittings (not shown) and are referred to collectively as cavities 15. In this embodiment, two cavities 15*a*, 15*b* are arranged side by side in each row. The large cavities 15*a* in the upper row are for accommodating large female terminal fittings and the small cavities 15*b* in the lower row are for accommodating small female terminal fittings.

Figure 1:
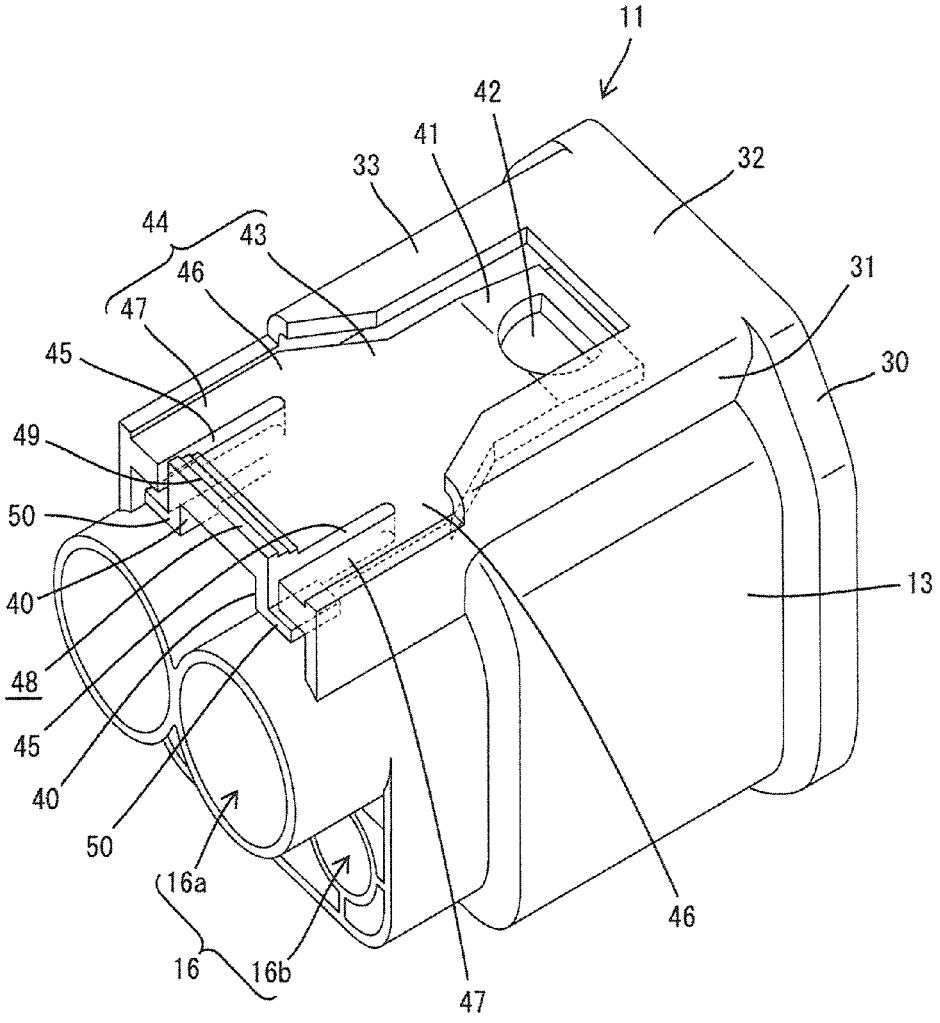
FIG. 1 is a perspective view of a female connector housing.

As shown in FIG. 1, a seal tower portion 16 for accommodating rubber plugs (not shown) fit on wires connected to the female terminal fittings is formed continuously on a rear part of the cavities 15. The seal tower portion 16 includes large seal towers 16*a* that extend back from the large cavities 15*a* and small seal towers 16*b* that communicate with the small cavities 15*b*. The large seal towers 16*a* have a greater rearward projecting length than the small seal towers 16*b*.

Figure 5:
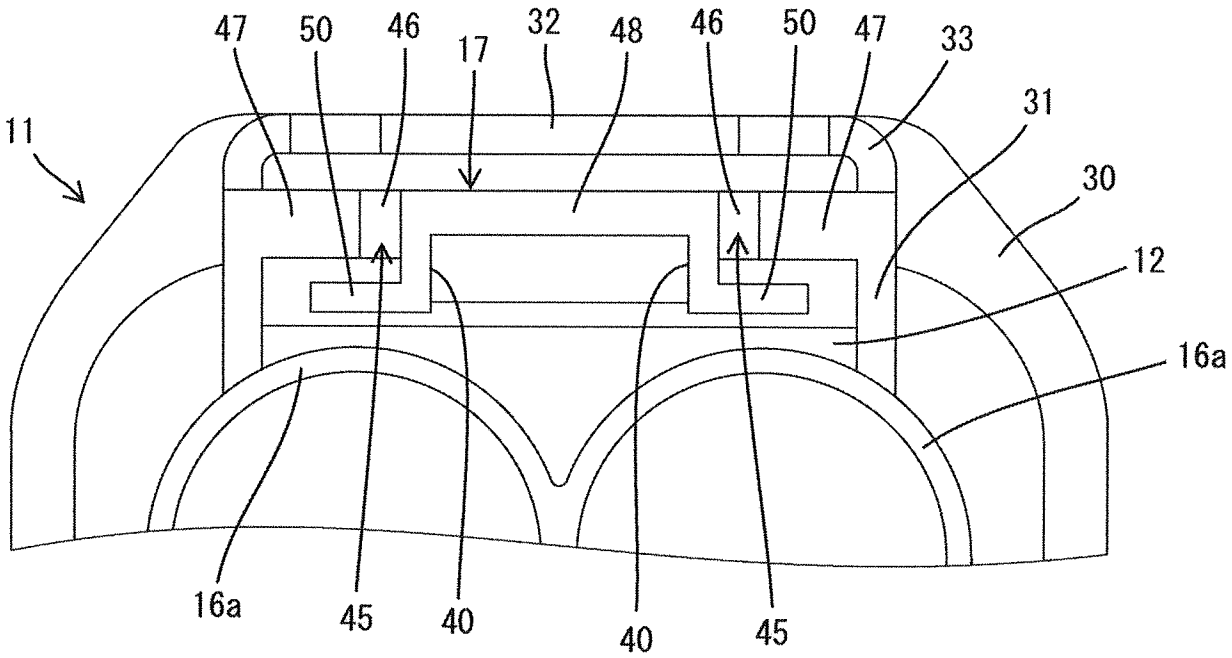
FIG. 5 is a rear view showing a part of the female connector housing.

The receptacle 13 is a substantially rectangular tube that is open forward in a connecting direction, as shown in FIG. 2, and a protruding edge 30 protrudes like a flange on the front end of the receptacle 13, as shown in FIG. 1. Two protection walls 31 stand on the upper surface of the female connector housing 11 and extend back in the connecting direction. Front end parts of both protection walls 31 are connected to the protruding edge 30 and are connected to each other by a connection wall 32. The upper surface of the connection wall 32 is flush with the upper surface of the protruding edge 30. Bent edges 33 extend horizontally in over a predetermined length on parts of the upper edges of the protection walls 31 behind the connection wall 32. The protection walls 31 extend farther back from the parts where the bent edges 33 are formed, and lower edge parts of the backward extending parts are connected to the outer peripheral surfaces of the large seal towers 16*a*. More specifically, as shown in FIG. 5, parts where the protection walls 31 are formed are displaced outwardly in a width direction from the uppermost parts of the outer peripheral surfaces of the large seal towers 16*a* and the positions of the rear ends of the protection walls 31 are spaced forward from the rear ends of the large seal towers 16*a*, as shown in FIG. 1.

Figure 3:
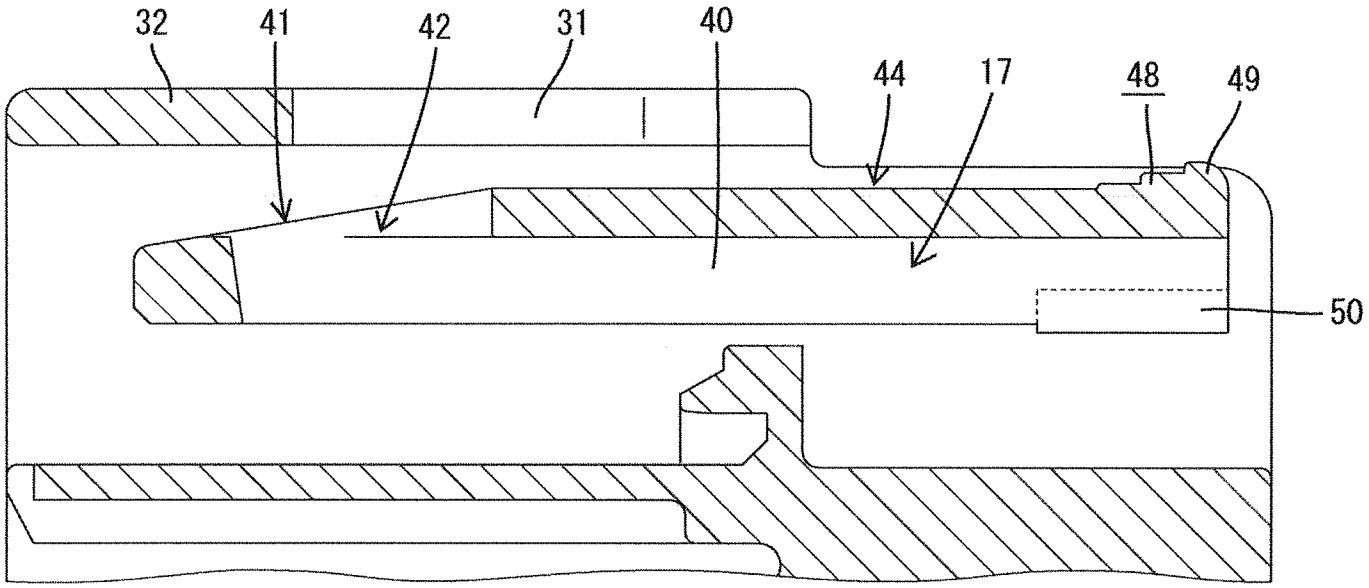
FIG. 3 is a side view in section showing a part surrounding a lock arm.
Figure 4:
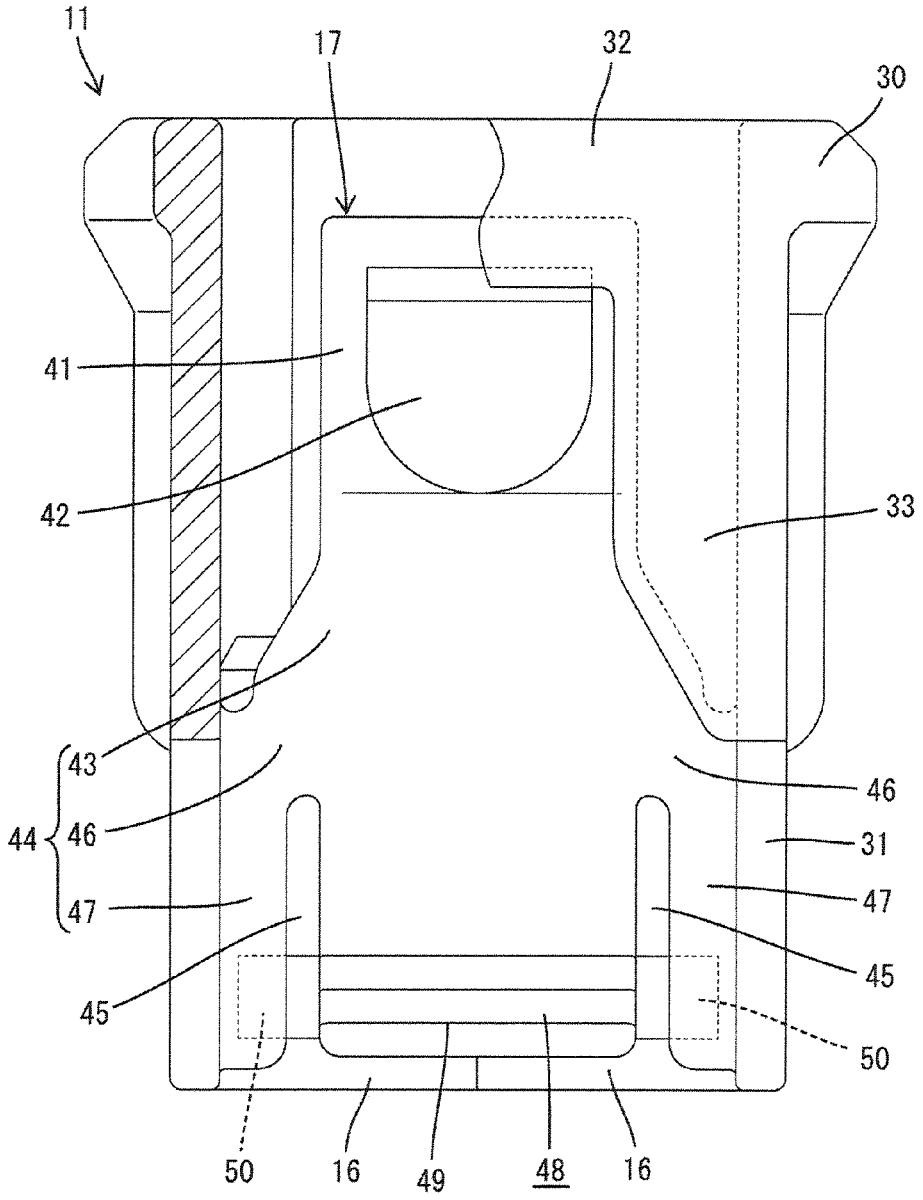
FIG. 4 is a plan view partly in section showing the female connector housing.

The lock arm 17 for locking a connected state to the mating connector housing is arranged between protection walls 31. Two reinforcing edges 40 extend down over substantially the entire length on opposite widthwise side edges of the lock arm 17 (see FIGS. 1 and 5). As shown in FIG. 4, a front part of the lock arm 17 is narrower than a rear part thereof and an inclined surface 41 is formed on the upper surface of the front half and slopes down toward the front (see FIG. 3). A lock hole 42 is formed on the inclined surface 41 and is engageable with a lock projection (not shown) of the mating connector housing. The front half of the lock arm 17 is slightly wider than a spacing between the bent edges 33, and the opposite widthwise side edges of the lock arm 17 overlap the bent edges 33 in plan view (see FIG. 4).

An intermediate portion 43 is between from the front and rear parts of the lock arm 17 and has a width that gradually increases toward the back. The lock arm 17 is not connected to the protection walls 31 in a length range from the front half to the intermediate portion 43, but the rear half is connected to the protection walls 31 over its entire length range. Further, when the lock arm 17 is in a natural state (state shown in FIG. 3), the entire upper surface of the lock arm 17 excluding the inclined surface 41 forms a plane having substantially the same height. This region is referred to as a planar portion 44.

Two grooves 45 are formed entirely through the planar portion 44 inward of the protection walls 31. The grooves 45 are formed by cutting to extend along the connecting direction from the rear edge of the lock arm 17 (planar portion 44). Front ends of the grooves 44 are located behind the intermediate portion 43. Thus parts of the planar portion 44 between front ends of the grooves 45 and a rear of the intermediate portion 43 define deflection supports 46 that allow the lock arm 17 to be deflected and displaced like a seesaw in the height direction. Further, parts of the planar portion 44 outward of the grooves 45 in the width direction define reverse-turn preventing walls 47 that protrude horizontally in from the protection walls 31. In this way, the deflection supports 46 and the reverse-turn preventing walls 47 have the same height and are coplanar.

An operating portion 48 is defined in an area of the planar portion 44 between the grooves 45 and is used to release a locking state of the lock arm 17. An anti-slip portion 49 is formed on a rear part of the operating portion 48 and is sloped slightly up toward the back. As shown in FIG. 5, two reverse-turn preventing pieces 50 protrude out in the width direction on a rear part of the operating portion 48, specifically on rear parts of the reinforcing edges 40. The reverse-turn preventing pieces 50 are located below the corresponding reverse-turn preventing walls 47 and contact the corresponding reverse-turn preventing walls 47 to prevent the lock arm 17 from being turned excessively up, when the operating portion 48 side of the lock arm 17 is about to be deflected excessively up.

It should be noted that the female connector housing 11 of this embodiment, including the lock arm 17 and the protection walls 31, is formed by a mold that is opened in forward and backward directions along the connecting direction.

The female connector housing 11 is opposed and fitted to the male connector housing for connection and a leading end part of the lock arm 17 moves onto the lock projection on the male connector housing. Therefore the lock arm 17 is deflected and displaced like a seesaw about the deflection supports 46. The leading end of the lock arm 17 passes over the lock projection as the connecting operation proceeds further. Thus, the lock arm 17 resiliently restores and the lock projection engages the lock hole 42 to hold the male and female connector housings in a completely connected state.

Conversely, the operating portion 48 of the lock arm 17 is pressed to separate the male and female connector housings. Thus, the lock arm 17 pivots about the deflection supports 46 and a leading end of the lock arm 17 is lifted up. Thus, the lock hole 42 and the lock projection disengage. Accordingly, the male and female connector housings can be pulled apart and separated.

An upward force could act on the operating portion 48 end of the lock arm 17 to lift the operating portion 48 up. However, the reverse-turn preventing pieces 50 contact the corresponding reverse-turn preventing walls 47 to prevent the lock arm 17 from being turned up and avoiding a situation where the lock arm 17 is deformed plastically.

According to this embodiment, the deflection supports 46 and the reverse-turn preventing walls 47 are formed in the rear part of the lock arm 17 and the grooves 45 are cut to extend from the rear end of the planar portion 44. The female connector housing 11 including these configurations can be formed by a mold that is opened along the connecting direction, so that a mold structure can be simple. As a result, the deflection supports 46 and the reverse-turn preventing walls 47 of the lock arm 17 are formed at the same height, so that the height of the female connector housing 11 can be reduced and the entire female connector housing 11 can be miniaturized as compared with the conventional example in which there is a height difference between deflection supports and reverse-turn preventing walls.

Figure 6:
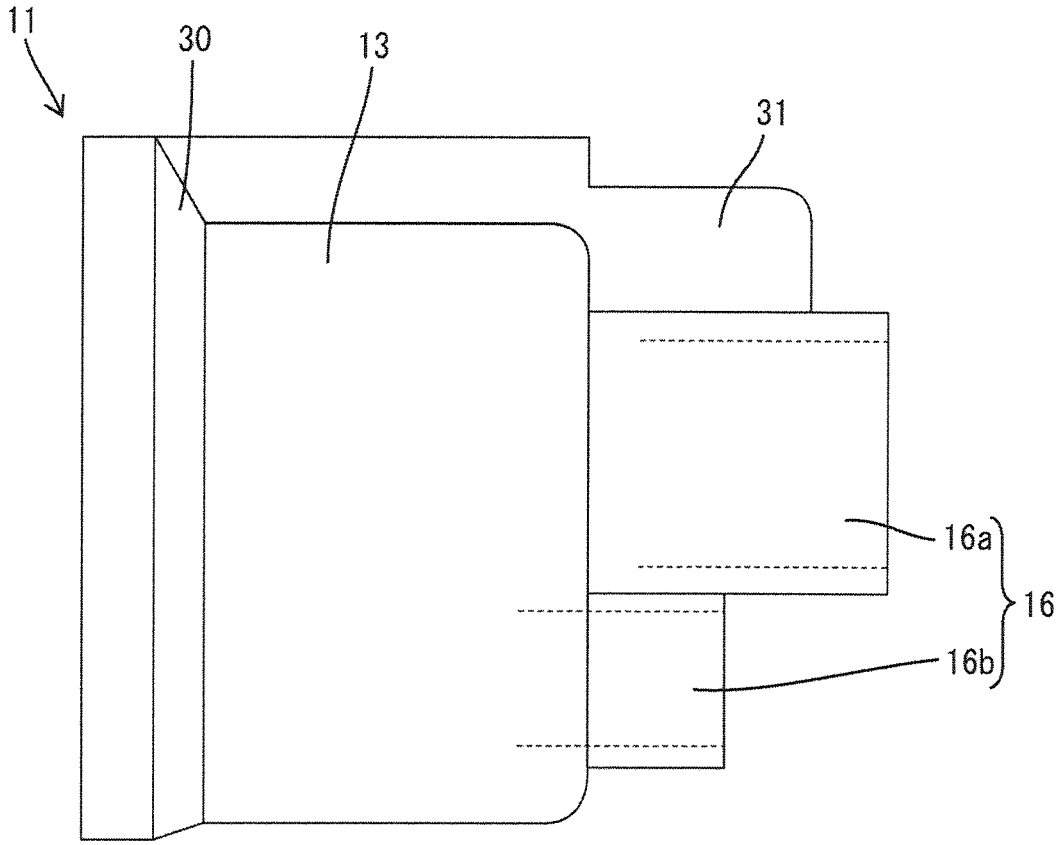
FIG. 6 is a side view of the female connector housing.
Figure 7:
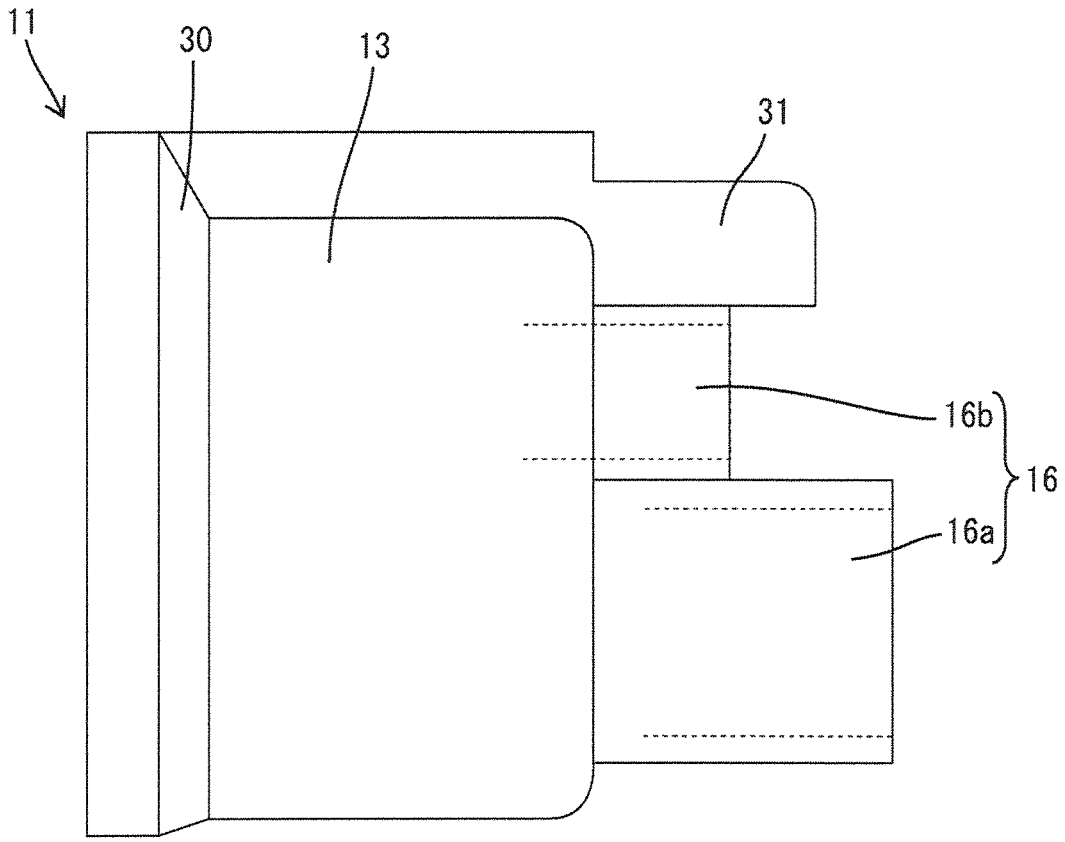
FIG. 7 is a side view of a comparative example of a female connector housing.

Further, the small seal towers 16*b* have a relatively short backward projection length and are arranged in the lower row on the rear surface of the female connector housing 11 (see FIG. 6). Contrary to this, if the small seal towers 16*b* were arranged between the protection walls 31 (lock arm 17) and the large seal towers 16*a* having a relatively long backward projection length from the female connector housing 11 as in a comparative example shown in FIG. 7, fingers would touch the large seal towers 16*a* and the protection walls 31 (lock arm 17) when inserting the terminal fittings into the small seal towers 16*b*. Thus, an inserting operation would be more difficult. However, the small seal towers 16*b* are in the lower row in this embodiment, and there is a sufficient work space below and the terminal fitting inserting operation can be performed smoothly.

The invention is not limited to the above described and illustrated embodiment and the following embodiments also are in the scope of the invention.

Although the backward extension lengths of the seal towers differ between the upper and lower rows in the above embodiment, they may be the same in the upper and lower rows or a length relationship may be reversed between the upper and lower rows. Further, the number of the rows of the cavities should not be limited.

Although application to the waterproof connector is shown in the above embodiment, application to a non-waterproof connector is also possible.

What is claimed is:

1. A connector, comprising:

a connector housing;

left and right protection walls projecting from the connector housing;

a resiliently deflectable lock arm formed between the protection walls and resiliently engageable with a mating connector;

left and right deflection supports respectively connecting the left and right protection walls and the lock arm and supporting the lock arm during resilient deflection;

at least one reverse-turn preventing wall protruding from at least one of the protection walls toward the lock arm and being coplanar with the left and right deflection supports; and at least one reverse-turn preventing piece protruding out from the lock arm and disposed below the reverse-turn preventing wall and configured to contact the reverse-turn preventing wall for limiting deflection of the lock arm.

2. The connector of claim 1, wherein a rear part of the lock arm behind the deflection supports in a connecting direction includes a planar portion connected to the protection walls, the planar portion being substantially coplanar with the reverse-turn preventing wall and the deflection supports.

3. The connector of claim 2, wherein the planar portion is formed with two grooves extending along a connecting direction from a rear end of the planar portion to the deflection supports and separating the planar portion from the reverse-turn preventing wall.

4. The connector of claim 3, further comprising an operating portion at a rear end of the lock arm between the grooves, the operating portion being pressable for releasing a locking state of the lock arm.

5. The connector of claim 4, wherein the at least one reverse-turn preventing wall is laterally outward of one the grooves.

6. The connector of claim 1, wherein the at least one reverse-turn preventing wall comprises two reverse-turn preventing walls protruding respectively from the protection walls toward the lock arm, and the at least one reverse-turn preventing piece comprises two reverse-turn preventing pieces protruding out from the lock arm and disposed respectively below the reverse-turn preventing walls.

7. A connector, comprising:

a connector housing;

two protection walls projecting from the connector housing;

a resiliently deflectable lock arm formed between the protection walls and resiliently engageable with a mating connector;

deflection supports connecting the protection walls and the lock arm and supporting the lock arm during resilient deflection;

at least one reverse-turn preventing wall protruding from at least one of the protection walls toward the lock arm and being substantially coplanar with the deflection supports;

at least one reverse-turn preventing piece protruding out from the lock arm and disposed below the reverse-turn preventing wall and configured to contact the reverse-turn preventing wall for limiting deflection of the lock arm; and seal towers projecting rearward at a rear end of the connector housing and arranged in rows along a height direction of the connector housing.

8. The connector of claim 7, wherein the protection walls are connected to outer peripheral surface region of the seal towers arranged in the row closest to the lock arm.

9. The connector of claim 8, wherein the seal towers have different backward extension lengths along the connector housing and are so arranged that the extension length becomes shorter from the seal towers closest to the lock arm to the seal towers more distant from the lock arm.

* * * * *